US005091150A

United States Patent [19]

Memmi et al.

[11] Patent Number: 5,091,150

[45] Date of Patent: Feb. 25, 1992

[54] ZINC-ALUMINIUM BASED ALLOY FOR COATING STEEL PRODUCTS

[75] Inventors: Massimo Memmi; Gelasio Giardetti, both of Rome, Italy

[73] Assignee: Nuova Italsider SpA, Genoa, Italy

[21] Appl. No.: 579,261

[22] Filed: Sep. 6, 1990

Related U.S. Application Data

[63] Continuation of Ser. No. 324,542, Mar. 16, 1989, abandoned, which is a continuation of Ser. No. 66,935, Jun. 26, 1987, abandoned.

[30] Foreign Application Priority Data

Jul. 14, 1986 [IT] Italy ..... 48263 A/86

[51] Int. Cl.[5] ..... C22C 21/10; B32B 15/01

[52] U.S. Cl. ..... 420/541; 420/519; 420/546; 428/653; 428/659

[58] Field of Search ..... 420/519, 541, 546; 428/653, 659; 148/437, 440

[56] References Cited

U.S. PATENT DOCUMENTS 3,343,930 9/1967 Borzillo et al. ..... 428/653

4,610,936 9/1986 Isobe et al. ..... 420/519

*Primary Examiner*—R. Dean

*Assistant Examiner*—Robert R. Koehler

*Attorney, Agent, or Firm*—Young & Thompson

[57] ABSTRACT

Zinc-aluminum based alloy containing magnesium and silicon, both present in quantities up to 0.5% by weight, characterized by very good corrosion resistance and suitable for coating steel products, the resulting coatings being extremely durable and highly flexible.

3 Claims, No Drawings

ZINC-ALUMINIUM BASED ALLOY FOR COATING STEEL PRODUCTS

This application is a continuation of application Ser. No. 07/324,542, filed Mar. 16, 1989, which is a continuation of application Ser. No. 07/066,935, filed June 26, 1987, both now abandoned.

This invention relates to a zinc-aluminium based alloy for coating steel products. More precisely it relates to a zinc-aluminium based alloy that provides coatings which are mechanically strong and corrosion resistant over the long term.

It is known and described in "La Metallurgia Italiana" n.3-1982, pages 139–154, that when zinc and aluminium based alloys are used for hot coating steels, during cooling after application of the alloy on the base, different phases having different compositions separate at various temperatures. What occurs is that an aluminium-rich phase solidifies in dendritic form, while a phase which is poor in aluminium solidifies in the interdentritic spaces. As a consequence, under corrosion conditions, such alloy is subjected both to the effect of the galvanic couples which are established between the high-Al and low-Al zones and to the normal causes of attack.

Alloys with a high aluminium content—e.g. 70% by weight—have been developed to minimize the magnitude of this phenomenon. However, high aluminium contents cause drawbacks in hot-coating processes, f.i. the increase in the cost of the process and the plant, especially because of the too high bath temperatures. Moreover such baths are much more readily oxidized, and brittle phases such as Fe-Al, Fe-Zn and Fe-Al-Zn are easily formed.

Low-aluminium zinc-aluminium alloys, also containing other alloy elements, such as magnesium and silicon, have therefore been developed to stabilize the alloy from the corrosion aspect. Such alloys are described in the same cited reference. These additional alloy elements improve the corrosion resistance of the coatings and also their adhesion to the ferrous base, since magnesium allows reduction of the aluminium content, with no loss in corrosion resistance, and silicon inhibits excessive reactivity between aluminium and iron during coating operations.

Though such alloys show good corrosion resistance and good adhesion to the ferrous base, the life of steel coatings thus obtained is decidely limited.

Surprisingly it has been found that simultaneous addition of very low specific quantities of magnesium and silicon to zinc-aluminium alloys improves their corrosion resistance, while the resulting coatings have high plasticity and are extremely long lasting.

The object of this invention is thus the production of a zinc-aluminium alloy that is corrosion resistant, especially in chloride environments. Another object of the invention is the production of a zinc and aluminium based alloy that can be used to coat ferrous bases, the resulting coatings showing enhanced plasticity and being extremely long lasting. The alloy according to the present invention, suitable for coating steels, comprises:

magnesium from 0.01% to 0.5% by weight;

silicon from 0.05 to 0.5% by weight; the balance being zinc, aluminium and different elements present as impurities.

Preferably the alloy according to the present invention comprises:

magnesium, in quantities between 0.05 and 0.45% by weight;

silicon, in quantities between 0.1 and 0.4% by weight;

aluminium, in quantities between 20 and 35% by weight; the balance being zinc and different elements present as impurities.

The alloy according to the invention is suitable for coating steels, producing coatings that are corrosion-resistant, firmly adherent to the ferrous base, ductile and, especially, long lasting.

It has been found, in fact, that there is a critical value of the amount of magnesium which stabilizes the alloy regarding to the corrosion aspect by segregating that element in the interdentritic spaces. Once such critical value is exceeded, the effect is a cathodic overprotection of the steel base with a too fast consumption of the coating in the galvanic couple.

Now it has been found an optimum amount of magnesium which stabilizes the grain boundary without however inducing adverse secondary effects of cathodic overprotection.

Such behaviour of magnesium is probably enhanced by the presence of silicon in the alloy, even though in very low amounts. In fact, even if the silicon amount is less than 0.5% by weight, it still inhibits aluminium reactivity and promotes adhesion of the coating to the ferrous base, while greatly reducing the onset of microcracks in the coating when this is subjected to mechanical bending stresses.

Said behaviour of magnesium and silicon is not linked to the presence of specific quantities of aluminium, since they retain the above-mentioned characteristics even in aluminium-rich alloys, e.g. those containing around 70% Al by weight. In the present invention, therefore, the choice of the amount of aluminium is dictated, solely by economic criteria.

It is nevertheless important to emphasize that such restricted addition of alloy elements has unexpectedly permitted the development of cheap, low-aluminium alloys having the same good behaviour as more expensive ones having much higher aluminium contents.

The alloy according to the invention can be prepared and applied as a coating on steel using known methods.

Moreover, when using processes such as those described in "La Metallurgia Italiana" No 3, 1982, pages 139 to 154, and employing restricted amounts of magnesium and silicon such as those of the invention, a drastic reduction of mixed oxide (Mg, Al and Zn) slags occurs, thus permitting further improvement in the quality of the coatings and increasing bath yields. In order to exemplify the present invention without limiting it, zinc-alluminum alloys containing different quantities of silicon and magnesium have been prepared and used to coat 0.8 mm steel strip by the Sendzionir process. The alloy compositions are indicated in Table 1 which does not show the zinc content, which is obviously the balance to 100%. The coating thickness was around 20 μm.

TABLE 1

| Alloy No. | Al % wgt | Si % wgt | Mg % wgt | SSC * | Galvanic couple** | Number of microcracks |
|---|---|---|---|---|---|---|
| 1 | 23 | 0.95 | 0.80 | 0.72 | 60 | 60 |
| 2 | 55 | 1.60 | — | 0.63 | 13 | 30 |
| 3 | 70 | 3.20 | 0.80 | 0.32 | 45 | — |
| 4 | 20 | 0.40 | 0.20 | 0.47 | 18 | 15 |
| 5 | 20 | 0.40 | 0.40 | 0.50 | 27.5 | 10 |
| 6 | 30 | 0.40 | 0.20 | 0.35 | 15 | 12 |
| 7 | 30 | 0.40 | 0.40 | 0.40 | 25 | 10 |

TABLE 1-continued

| Alloy No. | Al % wgt | Si % wgt | Mg % wgt | SSC * | Galvanic couple** | Number of microcracks |
|---|---|---|---|---|---|---|
| 8 | 70 | 0.20 | 0.20 | 0.25 | 25 | — |
| 9 | 70 | 0.40 | 0.40 | 0.28 | 35 | — |

*Corrosion rate in ASTM B117 Salt Spray Cabinet Values in $\Delta$ g/m$^2$ per day
**Galvanic couple measurements expressed as $\mu$A.

Test specimens measuring 100×50 mm were then taken from the coated strip. Such specimens were submitted to corrosion tests in a salt spray cabinet, according to ASTM B117 method, and to galvanic protection tests by reading the couple current set up between coating and ferrous base. The coating-steel coupling was effected in an 0.1N NaCl solution using a 1:5 ratio between coating and steel surfaces. The reading was taken two hours after effecting the coupling.

The results of the corrosion tests are expressed as loss of weight of the specimens. The weight losses were determined after removal of the products of corrosion by means of an aqueous solution of chromic anhydride (20% v/v) at pH5 and 60° C., the specimens being dipped for thirty seconds.

As is evident from Table 1, the best results are given by those alloys having a magnesium and silicon content of less than 0.5% by weight. It should be pointed out that in Alloy 3, which is not an alloy according to the invention, the very low corrosion rate is due to the presence of a large quantity of aluminium (70% by weight); in fact, its corrosion behaviour is apparently worse than the one of Alloys 8 and 9, having the same high Al content but in which silicon and magnesium contents are within present invention.

From the values obtained by measuring galvanic currents (see Table 1) it can be assumed that with the quantities of silicon and magnesium according to the invention, the current value is suitable both for protecting the iron base and for limiting coating corrosion, thus prolonging the coating life.

The flexibility tests were performed by bending the specimens through 180° on a 3 mm diameter mandrel.

Metallographic sections were then made of these specimens for inspection under optical microscope (×100), the number of microcracks at the point of maximum deformation being counted. As is evident from the Table 1 values, the number of microcracks is highly reduced in the test specimens coated with the alloys according to the invention with respect to the specimens coated with reference alloys.

We claim:

1. A corrosion-resistant alloy suitable for hot-dip coating steels, consisting essentially of aluminum: about 70% by weight
silicon: 0.05 to 0.5% by weight
magnesium: 0.01 to 0.5% by weight, balance essentially zinc.

2. Steel products coated with an alloy as in claim 1.

3. An alloy as claimed in claim 1 in which the silicon and magnesium are each about 0.20% by weight.

* * * * *